United States Patent [19]

Lapcevic

[11] Patent Number: 4,753,437

[45] Date of Patent: Jun. 28, 1988

[54] WEIGHTLIFTING EXERCISE DEVICE

[76] Inventor: Paul S. Lapcevic, Apt. 302, Kings Court Apartments, Washington, Pa. 15301

[21] Appl. No.: 22,004

[22] Filed: Mar. 5, 1987

[51] Int. Cl.[4] ..... A63B 21/06

[52] U.S. Cl. ..... 272/117; 272/DIG. 4

[58] Field of Search ..... 272/117, 118, 123, 134, 272/DIG. 4, 143

[56] References Cited

U.S. PATENT DOCUMENTS

| | | | |
|---|---|---|---|
| 3,905,599 | 9/1975 | Mazman | 272/118 |
| 4,154,441 | 5/1979 | Gajda | 272/118 |
| 4,188,029 | 2/1980 | Brower et al. | 272/118 X |
| 4,346,888 | 8/1982 | Szabo | 272/118 |
| 4,354,675 | 10/1982 | Barclay et al. | 272/118 |
| 4,406,452 | 9/1983 | Lapcevic | 272/117 X |

FOREIGN PATENT DOCUMENTS

| | | | |
|---|---|---|---|
| 735331 | 5/1966 | Canada | 272/117 |
| 208551 | 4/1984 | German Democratic Rep. | 272/117 |

*Primary Examiner*—Richard J. Apley
*Assistant Examiner*—Robert W. Bahr
*Attorney, Agent, or Firm*—Paul Bodgon

[57] ABSTRACT

A weight lifting exercise device is described. The device includes an upright standing main support frame formed of interconnected vertical and horizontal support members. A weight support carriage for detachably securing weight members is supported by the main frame for vertical movement with respect to the main frame. A cable is secured at one end to the carriage and is reeved around pulleys. A gripper bar is secured to the free end of the cable and is disposed to be grasped by a user for raising and lowering the weight support carriage. A resistance converter assembly is supported by the main frame and is secured to the weight support carriage to vary the force resistances on the carriage as the carriage is moved vertically. The resistance converter assembly includes a beam member having one end pivotably secured to the weight support carriage, and a bearing pivotably supported by vertical members of the main frame, the bearing supporting the beam member for rectilinear movement in response to the veritcal movement of the weight support carriage. The beam member supports a rod member for detachably supporting drag weights, and the main frame may be selectively positioned for varying the vertical position of the bearing which permits varying the angle the beam makes with the weight support carriage.

6 Claims, 2 Drawing Sheets

WEIGHTLIFTING EXERCISE DEVICE

BACKGROUND OF THE INVENTION

This invention relates to a single-station type body exercising weight lifting device, and more particularly to a weight lifting device in which the exercise weights are supported by a vertically movable carriage connected by a cable reeved about pulleys where the user may apply an upward or downward force against the carriage.

In developing certain body muscles by weight lifting it is desirable that those muscles be subjected to a maximum resistance at selected segments in the full range of movement of the weights. Free weight exercising does not allow maximum resistance through all segments of the exercise cycle. Most currently known and used weight lifting devices which use a vertically moveable weight support carriage connected with a cable reeved through a pulley system are also not capable of providing maximum resistance throughout all segments of the exercise cycle. Because they do not allow maximum resistance at all points in the entire exercise cycle, free weights and devices of this cablepulley type are limited in the degree of strength gains sought by the user.

This invention overcomes the degree of strength gain limitations inherent in currently known and used cablepulley type weight exercise devices by providing such a device having the capability of providing maximum resistance at chosen positions in the full range of the possible exercise cycles. As a result, my invention provides the user with a potentially greater increase in the development of certain muscle strength than is possible with existing cable-pulley type devices.

SUMMARY OF THE INVENTION

This invention provides a weight lifting exercise device of the cable-pulley type which preferably comprises: a main support frame including upright members interconnected with cross-members; a weight support carriage movable vertically within the main frame, the carriage being provided with means for detachably supporting weight members: a cable guide means fixed to the main frame; a length of cable secured at one end to the weight support carriage and reeved about the cable guide means; a gripping means secured to the free end of the cable for being grapsed to transmit a vertical movement force to the weight support carriage; a resistance converter assembly supported by the main frame and secured to the weight support carriage for varying the force resistance on the weight support carriage as the carriage is moved vertically; the resistance converter includes an elongated beam member having one end pivotably secured to the weight support carriage, and a bearing secured by vertical members of the main frame and supporting the beam member for rectilinear movement in response to the vertical movement of the weight support carriage.

The cable guide means of my invention may be arranged above the weight support carriage and supported by the main frame. The cable would have one end attached to the weight support carriage with the free end of the cable securing a gripper bar. Such an arrangement would provide a pull down weight lifter exercise device. Also, the cable guide means could consist of one or more upper pulley assemblies arranged above the weight support carriage and one or more lower pulley assemblies beneath the upper assemblies.

This type arrangement would provide a variation of the pull down weight lifting device or a leg curl/leg extension device where a leg gripping or grasping assembly would be secured to the free end of the cable.

The resistance converter of my invention provides a means to vary the resistance that is felt by the user. In so doing the resistance converter allows a maximum resistance to be realized at chosen positions in the full range of movement of the weight. Also, the resistance converter is capable of being arranged to vary the resistance by providing for an adjustment of the vertical location of the bearing and/or by providing means on the beam member for removably securing any desired number of drag weights. Thus, my resistance converter provides for a range of working resistance whereby the user may select the resistance force to accommodate a desired need.

The resistance converter of my present invention achieves the result of providing the maximum resistance at chosen positions in the full range of exercise movement by applying the inclined plane principle which requires more force to move the weights against an upwardly inclined force. Without an upwardly inclined force acting on the vertically movable weights, the resistance force acting on the user would remain constant as the weights are raised upwardly.

Various other advantages, details, and modifications of the present invention will become apparent as the following description of a present preferred embodiment proceeds.

DESCRIPTION OF THE DRAWING

In the accompanying drawings I show a cetain present preferred embodiment of my invention in which.

DESCRIPTION OF A PREFERRED EMBODIMENT

Figure 1:
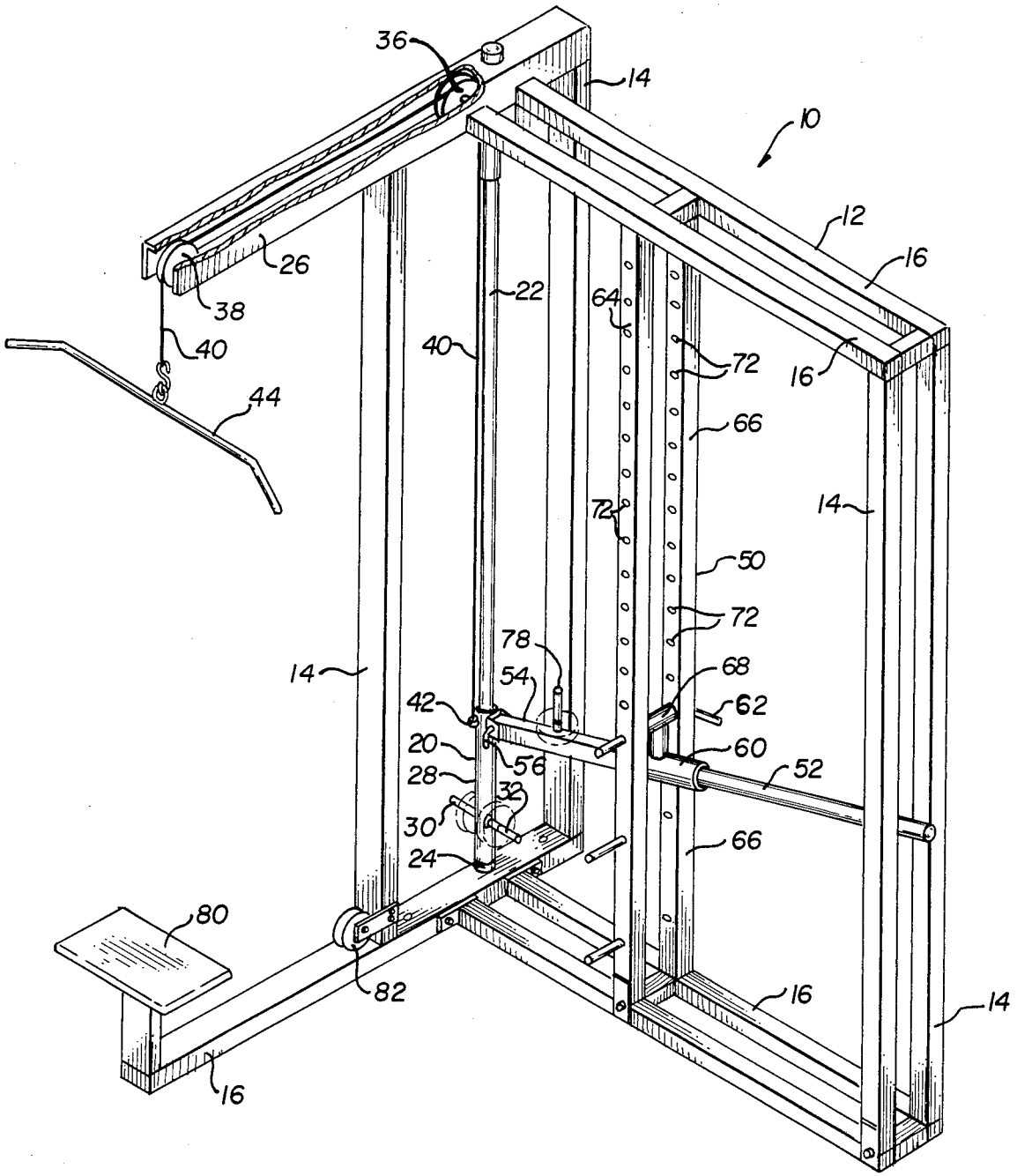
FIG. 1 is a perspective view of a weight lifting exercise device embodying my present invention.
Figure 2:
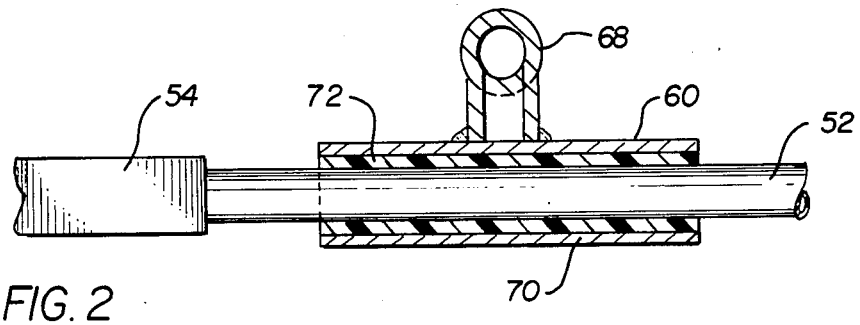
FIG. 2 is an exploded view of part of the beam member and the bearing forming part of the resistance converter of my present invention.
Figure 3:
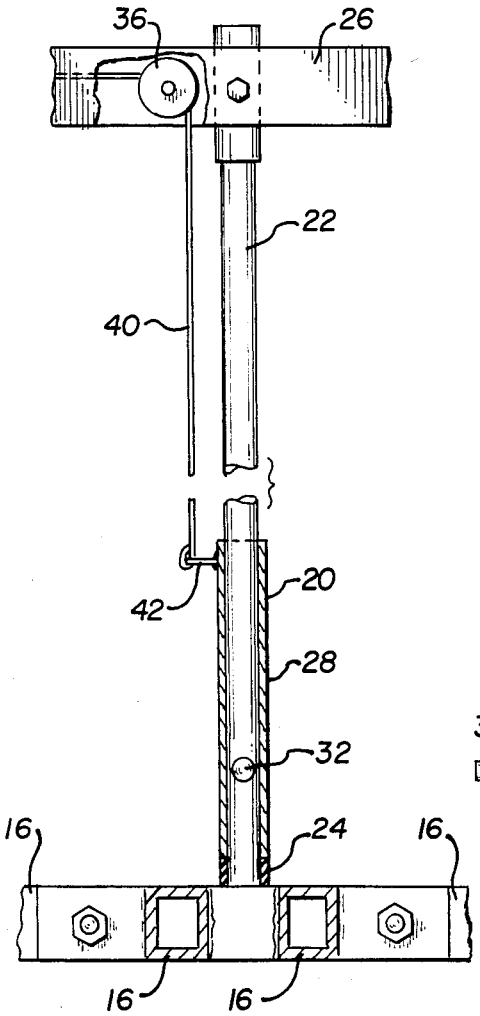
FIG. 3 is a partial elevation view of the weight support carriage, shown in section, and the guide bar for the carriage, with parts removed showing details of construction.
Figure 4:
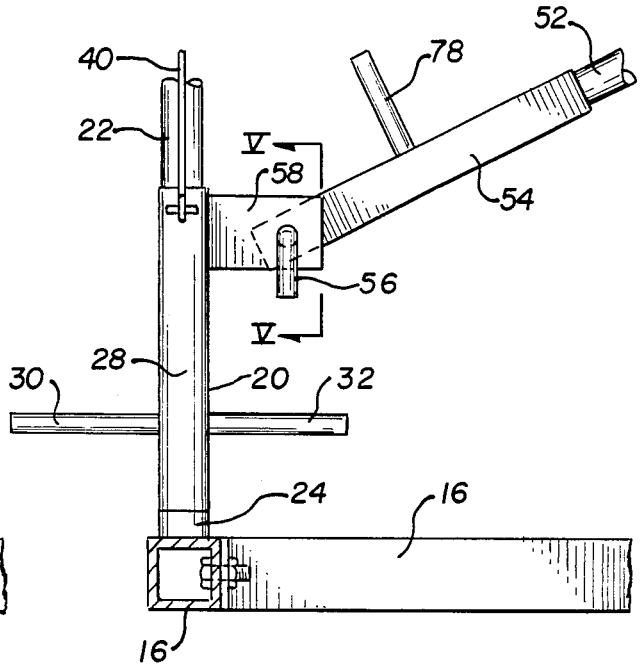
FIG. 4 is an elevation view of part of the weight support carriage and the beam member of the resistance converter of my invention showing the pivotable connection between the beam member and the carriage.
Figure 5:
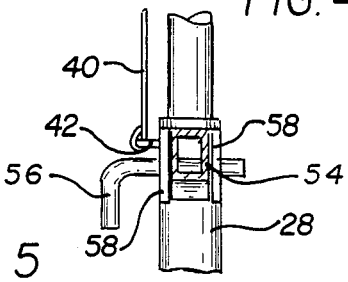
FIG. 5 is a view taken along the line V—V of FIG. 4.

Referring now to the drawings, there is shown a weight lifting exercise device 10 known commonly as a pulldown machine and referred to in this specification as a cable-pulley type exercise device. Weight lifting exercise device 10 embodies my present invention and includes a box-shaped main support frame 12 formed of a series of inteconnected vertical and horizontal beam members 14 and 16, respectively, arranged such that the device may stably rest on a floor surface. Supported by the main frame 12 is a weight support carriage assembly 20 arranged to move vertically with respect to the main frame and to detachably secure any desired number of weights. The weight support carriage assembly 20 includes a vertically arranged elongated tubular guide bar 22 secured at its lower end to a left side horizontal beam member 16 by a bracket 24 fixed to the horizontal beam member by welding, bolts, or the like. The upper end of this guide bar 22 is secured to a channel beam 26 which extends laterally of the main frame 12 and is suitably fixed to the upper end portion of left side vertical beam members 14 of the main frame. Weight support carriage assembly 20 also includes a tubular carriage 28 slidably arranged on the guide bar 22, with the carriage 28 having fixed thereon a pair of coaxial weight support bars 30 and 32 for detachably supporting standard type weights.

A cable and pulley guide assembly is arranged for applying the motivating force needed to move carriage 28 vertically on the guide rod 22. A first pulley 36 is rotatably supported within the confines of the channel beam 26 adjacent the upper section of guide rod 22, and a second pulley 38 laterally spaced from the first pulley 36 is likewise rotatably supported with beam 26 at the free end section thereof. Reeved about the first and second pulleys 36 and 38 is a cable segment 40 which has one end secured to the carriage 28 on an eyebolt 42 or the like fixed to the body of the carriage. A standard type gripper bar 44 is secured to the free end of the cable segment 40 and is arranged to be grasped for raising and lowering the carriage 28 during an exercise cycle.

My resistance converter assembly 50 is supprted by main frame 12 and is arranged to act on the weight support carriage assembly 20 for varying the force resistance on the carriage 28 whereby a maximum resistance zone is realized at selected portions of the full range of movement of the carriage 28 during an exercise cycle. My resistance converter assembly 50 includes an elongated shaft 52 coupled with one end of a drag weight housing 54 to form a continuous shaft assembly. The free end of drag weight housing 54 is pivotably secured to the weight support carriage 28 by means of a pivot pin 56 extending through coaxial openings in a yoke 58 fixed to an upper region of the carriage 28 and openings in the free end section of the drag weight housing 54. A bearing 60 is pivotably supported on a pivot pin 62 extending through coaxial openings in vertical support members 64 and 66 which are supported between horizontal beam members 16 of the main frame 12. The pivot pin 62 extends through an opening in an ear member 68 fixed to the main housing 70 of the bearing 60. Bearing 60 is arranged to slideably receive the shaft 52 such that when the weight support carriage 28 is moved vertically on the guide rod 22 the shaft 52 will translate rectilinearly within the bearing 60 as the entire assembly of the shft 52 and the drag weight housing 54 pivots relative to the carriage 28. The movement of the shaft 52 and drag weight housing 54 provides the inclined plane force resistance to the weight support carriage 28, as earlier described.

The bearing 60 contains any suitable internal construction such as non-metallic sleeve 72 or ball bearing support means to permit the shaft 52 to slide during vertical movement of the weight support carriage 28. The pivot pin 62 securing the bearing 60 to the vertical support members 64 and 66 is removable to allow the bearing 60 and thus the shaft 52 and drag weight housing 54 to be fastened at different locations relative to the weight support carriage 28. As shown in FIG. 1, vertical support members 64 and 66 are provided with a series of regularly vertically spaced openings 72, thus permitting the support and pivot point of the bearing to be varied as described. By changing the vertical position of the bearing 60 location, the resistance force on the weight support carriage 28 will be selectively varied. The resistance force on weight support carriage 28 may also be increased by adding drag weights on drag weight housing 54. An upwardly extending rod 78 is suitably fixed on drag weight housing 54 for receiving standard type weights.

A seat assembly 80 may be secured to a horizontal beam member 16 of the main frame 12, as is shown in FIG. 1, for a user to get on while performing certain exercises. Also, as shown in FIG. 1, a third pulley assembly 82 may be rotatably secured to a lower section, as shown, or to any intemediate section of an outer vertical beam member 14 and thereby allow a cable segment, not shown, to be reeved around that third pulley to the second pulley 38, then to first pulley 36 and then to the weight support carriage. The user will thus have means available for performing other type exercises.

It should now be clearly understood how the weight lifting exercise device of my present invention provides maximum resistance zone at selected portions of the full range of exercise movement, as was earlier described. It should also be apparent that the resistance location of the variable resistance itself is variable with my invention by varying the angle my resistance converter makes with the weight support carriage and/or by varying the magnitude of the drag weight on the resistance converter. Those skilled in this art would also recognize that my invention could be modified in different respects without changing its essence. one such modification would be to arrange resistance converters to act on both sides of the weight support carriage. Such an arrangement of resistance converters would provide a greater resistance intensity zone as compared with a single resistance converter arrangement.

Although a pull down type weight lifting exercise device has been described and illustrated, it is noted that my present invention may be readily modified to provide other types of exercise devices such as a leg curl/leg extension device, with the understanding that all such other devices fall within the scope of my invention. As those skilled in this art would readily recognize, a leg curl/leg extension exercise device would be formed where my cable guide means means would include at least one upper pulley assembly and one or more lower pulley assemblies. There would also be provided a bed or the like for the user to sit or lay on together with a pivotable leg grasper assembly at the remote end end of the bed. A cable would be attached at one end to the weight support carrige and reeved around the pulleys to be secured at its other end to the leg grasper assembly. Thus, any devices using a vertically movable weight support carriage and a pulley-cable system for transmitting force to the carriage fall within the scope of my present invention.

It is also to be noted that the expression gripping means used in the specification relates to any element or combination of elements for being grasped, gripped, or engaged by the hands, legs, shoulders, and the like of a user's anatomy for transmitting exercise force to the weight support carriage. Also when referring to a pulley assembly in this specification, it is noted that one or more pulleys and related elements would apply. In other words, the pulley assembly as used herein may comprise one or more pulleys. It is to be yet noted that the weight arrangement as described and illustrated on the weight support carriage is just one type of arrangement. The weights may be an arrangement of vertically disposed flat weights, the number of which may be selectively chosen by passing a pin through any one of the plates and on through a plunger rod which in turn may be lowered through the center of each plate in the stack.

While I have shown and described a present preferred embodiment of this invention, it is to be distinctly understood that the invention is not limited thereto, but may be otherwise embodied within the scope of the following claims.

I claim:

1. A weight lifting exercise device comprising:

a main support frame including upright members inteconnected with cross-members;

weight support carriage means movable vertically within said support frame for detachably securing a plurality of weight members;

cable guide means fixed to said support frame above said weight support carriage means;

a cable segment means secured at one end to said weight support carriage means and extending through said cable guide means;

gripping means secured to the free end of said cable segment for being grasped to transmit vertical movement force to said weight support carriage means; and resistance converter means supported by said main frame for varying the force resistance on said weight support carriage means as said weight carriage means is moved vertically, said resistance converter means including an elongated beam member having a housing of a predetermined weight with one end pivotably secured to said weight support carriage means and means fixed relative to said housing and having a predetermined weight, and bearing means secured to said support frame and supporting said beam member for rectilinear movement of said means fixed relative to said housing in response to the vertical movement of said weight support carriage means.

2. A weight lifting exercise device as set forth in claim 1 including means for selectively varying the vertical position of said bearing means of said resistance converter means.

3. A weight lifting exercise device as set forth in claim 1 wherein said cable guide means includes a first pulley assembly fixed to said support frame above said weight support carriage means, and a second pulley assembly laterally spaced from said first pulley assembly and fixed to said support frame above said support carriage means.

4. A weight lifting exercise device as set forth in claim 1 wherein said cable guide means includes a first pulley assembly fixed to said support frame above said weight support carriage means and a lower pulley assembly fixed to said support frame beneath said first pulley; and wherein said cable segment means extends through said first and lower pulley assemblies.

5. A weight lifting exercise device as set forth in claim 1 including drag weight support means supported by said housing of said beam member of said resistance converter means for detachably supporting drag weight members.

6. A weight lifting exercise device as set forth in claim 1 wherein said bearing means of said resistance converter means is pivotably secured by said support frame.

* * * * *